US009133738B2

(12) United States Patent
Cuneo

(10) Patent No.: US 9,133,738 B2
(45) Date of Patent: Sep. 15, 2015

(54) VARIABLE DISPLACEMENT LUBRICANT PUMP

(75) Inventor: Carmine Cuneo, Pisa (IT)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 21 days.

(21) Appl. No.: 13/989,060

(22) PCT Filed: Nov. 24, 2010

(86) PCT No.: PCT/EP2010/068128

§ 371 (c)(1),
(2), (4) Date: Jun. 28, 2013

(87) PCT Pub. No.: WO2012/069083

PCT Pub. Date: May 31, 2012

(65) Prior Publication Data

US 2013/0263815 A1 Oct. 10, 2013

(51) Int. Cl.

| | |
|---|---|
| ***F01M 11/02*** | (2006.01) |
| ***F04B 49/00*** | (2006.01) |
| ***F04B 35/00*** | (2006.01) |
| ***F01M 1/02*** | (2006.01) |
| ***F04C 2/344*** | (2006.01) |
| ***F04C 14/22*** | (2006.01) |

(52) U.S. Cl.

CPC ..... *F01M 1/02* (2013.01); *F04C 2/3442* (2013.01); *F04C 14/223* (2013.01); *F01M 11/02* (2013.01); *F04B 49/00* (2013.01); *F04C 2210/14* (2013.01)

(58) Field of Classification Search

CPC ..... F04B 17/05; F04B 49/007; F04B 49/002; F04B 49/08; F02B 2075/025; F02B 71/04; F02B 2075/027; F01M 1/02; F01M 11/02

USPC ..... 123/196 R; 417/364, 216, 26

See application file for complete search history.

(56) References Cited

U.S. PATENT DOCUMENTS

| | | | | |
|---|---|---|---|---|
| 4,342,545 | A * | 8/1982 | Schuster | 418/26 |
| 8,142,173 | B2 * | 3/2012 | Saga et al. | 417/364 |
| 8,202,061 | B2 * | 6/2012 | Shulver et al. | 417/216 |
| 2007/0224067 | A1 | 9/2007 | Arnold et al. | |
| 2008/0038117 | A1 * | 2/2008 | Armenio et al. | 417/26 |
| 2010/0028171 | A1 | 2/2010 | Shulver et al. | |

FOREIGN PATENT DOCUMENTS

| | | |
|---|---|---|
| CN | 101517236 A | 8/2009 |
| DE | 21 41 722 A1 | 3/1973 |

(Continued)

*Primary Examiner* — Lindsay Low
*Assistant Examiner* — Syed O Hasan
(74) *Attorney, Agent, or Firm* — Norman B. Thot

(57) ABSTRACT

A variable displacement lubricant pump providing a pressurized lubricant for an engine includes a control ring. A pump housing comprises a pump rotor with radially slidable vanes which rotate in the control ring. A pressure control chamber pushes the control ring into a low pumping volume direction against a force of a flexible pretensioning element. The pressure control chamber is connected with a pump outlet port via a first pressure conduit. A pretension control unit adjusts discharge pressures of the pressurized lubricant. The pretension control unit comprises a pretension cylinder with a plunger and an outlet opening arranged in a cylinder wall. The plunger is axially moveable and supports the flexible pretensioning element to push the control ring into a high pumping volume direction. The pretension cylinder is connected with the pump outlet port via a second pressure conduit. The outlet opening is connectable to a low-pressure via an electrical pretension control valve.

4 Claims, 1 Drawing Sheet

(56) References Cited

FOREIGN PATENT DOCUMENTS

| | | | |
|---|---|---|---|
| DE | 10 2005 050 216 | A1 | 4/2007 |
| DE | 10 2008 048 856 | A1 | 4/2010 |
| GB | 1 388 002 | | 3/1975 |
| WO | WO 2005/026553 | A1 | 3/2005 |
| WO | WO 2008/037070 | A1 | 4/2008 |

* cited by examiner

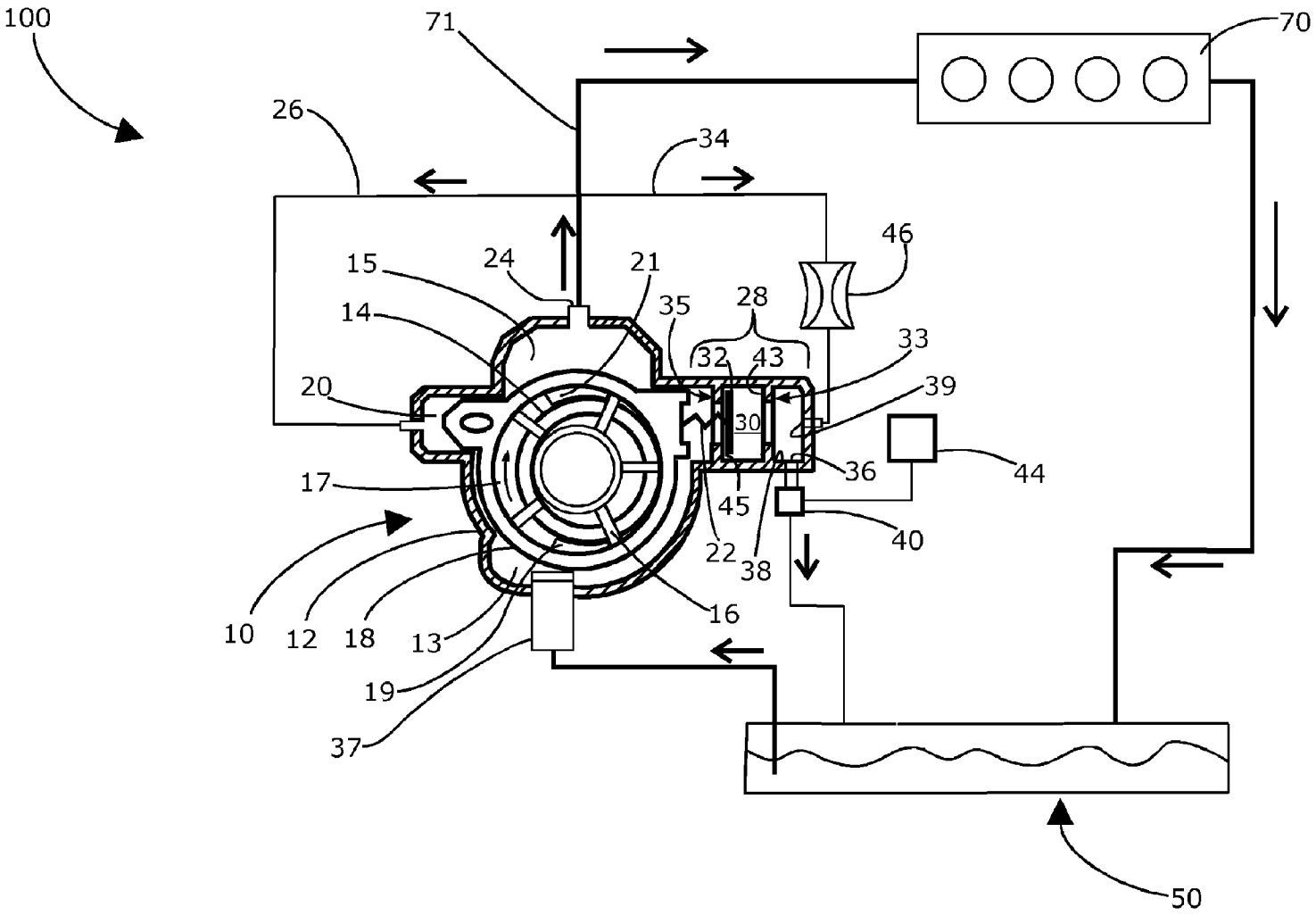
70
71
100
26
34
46
28
43
30
32
35
21
24
15
14
20
17
10
12
18
13
19
37
16
22
45
38
36
33
39
44
40
50

VARIABLE DISPLACEMENT LUBRICANT PUMP

CROSS REFERENCE TO PRIOR APPLICATIONS

This application is a U.S. National Phase application under 35 U.S.C. §371 of International Application No. PCT/EP2010/068128, filed on Nov. 24, 2010. The International Application was published in English on May 31, 2012 as WO 2012/069083 A1 under PCT Article 21(2).

FIELD

The present invention relates to a variable displacement lubricant pump for providing pressurized lubricant for an internal combustion engine.

BACKGROUND

Variable displacement pumps have previously been described. These pumps usually comprise a pump housing with a pump rotor, whereby the pump rotor is provided with radially slidable vanes rotating in a shiftable control ring. The control ring is pushed into a low or a high pumping volume direction depending on the rotational speed of the engine. If the rotational speed increases, the control ring is pushed into a low pumping volume direction; if the rotational speed decreases, the control ring is pushed into a high pumping volume direction so that the lubricant can be pressurized at a more or less constant level, independent of the rotational speed of the pump rotor or engine.

The lubricant pressure requirement is, however, dependent on the working conditions of the engine. The lubricant pressure requirement is lower at low rotational speeds and higher at high rotational speeds of the engine. A device with a control system which provides one level of pressure of the pressurized lubricant is described in WO 2005/026553 A1.

SUMMARY

An aspect of the present invention is to provide a compact variable displacement lubricant pump with more than one lubricant pressure level.

In an embodiment, the present invention provides a variable displacement lubricant pump for providing a pressurized lubricant for an internal combustion engine which includes a control ring configured to be shiftable. A pump housing comprises a pump rotor. The pump rotor comprises radially slidable vanes which are configured to rotate in the control ring. A first pressure conduit. A second pressure conduit. A pump outlet port. A pressure control chamber is configured to push the control ring into a low pumping volume direction against a force of a flexible pretensioning element. The pressure control chamber is connected with the pump outlet port via the first pressure conduit. A pretension control unit is configured to adjust at least one discharge pressure of the pressurized lubricant. The pretension control unit comprises a pretension cylinder comprising a plunger and an outlet opening arranged in a cylinder wall. The plunger is arranged so as to be axially moveable and to support the flexible pretensioning element so as to push the control ring into a high pumping volume direction. The pretension cylinder is connected with the pump outlet port via the second pressure conduit. An electrical pretension control valve. The outlet opening is connectable to a low-pressure via the electrical pretension control valve.

BRIEF DESCRIPTION OF THE DRAWINGS

The present invention is described in greater detail below on the basis of embodiments and of the drawings in which:

FIG. 1 schematically shows a pumping system including a variable displacement lubricant pump.

DETAILED DESCRIPTION

The variable displacement lubricant pump for providing a pressurized lubricant for an internal combustion engine comprises a pump housing with a pump rotor, whereby the pump rotor is provided with numerous radially slidable vanes rotating in a shiftable control ring, a pressure control chamber which pushes the control ring into a low pumping volume direction against the force of a flexible pretensioning element. The pressure control chamber is connected with a pump outlet port via a first pressure conduit. The pump further comprises a pretension cylinder, wherein a plunger is provided to be axially moveable. The pretension cylinder is integrated into the pump housing or can alternatively be a separate part which is fixed to the pump housing. The plunger supports the pretensioning element so that the control ring is pushed into a high pumping volume direction. The pretension cylinder is connected with the pump outlet port via a second pressure conduit. The pretension cylinder is provided with an outlet opening in a cylinder wall, whereby the outlet opening is connectable to a low-pressure by an electrical pretension control valve. Both the second pressure conduit inlet of the pretension cylinder and the outlet opening are arranged axially distally of the plunger in its low pressure position so that the plunger never covers the second pressure conduit inlet of the pretension cylinder and/or the outlet opening.

The plunger is switchable between two different positions. If the electrical pretension control valve opens the outlet opening, the pretension cylinder is connected to the low-pressure, for example, to atmospheric pressure. The plunger is in the low pressure position. The pump provides the pressurized lubricant, for example, with a pressure of approximately 2.5 bar. If the electrical pretension control valve closes the outlet opening, the pressure increases in the pretension cylinder so that the plunger is moved into the high pressure position. As a result, the equilibrium position of the control ring is moved into the high pressure position so that the pump provides the pressurized lubricant, for example, with a pressure of approximately 4.5 bar. In both pressure positions, the control ring can be pushed into a low or a high pumping volume direction so that both pressure levels are more or less constant, independent of the rotational speed of the pump rotor or the engine driving the pump.

The pump therefore provides two different lubricant pressure levels with a simple mechanical system, namely, with a pretension cylinder with an axially moveable plunger supporting a pretension element which pushes the control ring into high pressure direction. This allows a compact pump to be designed.

In an embodiment of the present invention, the pretension cylinder can, for example, be provided with a stopping element at each axial end of the pretension cylinder so that the plunger is exactly positioned at its two different preset positions.

In an embodiment of the present invention, the pretension control valve can, for example, be controlled by a pump control unit. The pump control unit is provided with set-values for the pretension control valve and determines the pressure set-value and thereby the plunger position dependent on engine conditions and parameters, such as lubricant temperature etc.

In an embodiment of the present invention, the second pressure conduit can, for example, be provided with a throttle valve and the pretension control valve is provided downstream of the pressure control chamber. The throttle valve limits the maximum lubricant consumption of the pretension cylinder.

One embodiment of the invention is hereinafter described with reference to the drawing.

FIG. 1 shows a variable displacement lubricant pump 10 as a part of a pumping system 100 for supplying an internal combustion engine 70 with a lubricant. The pump 10 comprises a pump housing 12 having a cavity 13 in which a radially shiftable control ring 18 can radially translate.

The control ring 18 encircles a pump rotor 14 which is provided with numerous radially slidable vanes 16, whereby the vanes 16 are rotating inside the control ring 18. The pump housing 12 is closed by two pump side walls 15 of which one is not shown in the drawing. The pump side walls 15, the vanes 16, the pump rotor 14 and the control ring 18 define five pump chambers 17. One of the side walls 15 is provided with a pump chamber inlet opening 19 and with a pump chamber outlet opening 21.

The pump 10 is provided with a pressure control chamber 20, whereby the pressure in the pressure control chamber 20 can push the control ring 18 into the low pumping volume direction against the force of a flexible pretensioning element 22. Opposite to the pressure control chamber 20, the pump 10 is provided with a pretension control unit 28 for adjusting different discharge pressures of the pressurized lubricant.

The pretension control unit 28 comprises a pretension cylinder 30 wherein an axially moveable plunger 32 is provided. The pretension cylinder 30 is provided with stopping elements 33, 35 at both axial ends of the pretension cylinder 30. The plunger 32 supports the pretensioning element 22 so that the control ring 18 is pushed into a high pumping volume direction. The plunger 32 is switchable into two different positions, namely, the low pressure position and the high pressure position, so that the pump 10 can pressurize the lubricant with two different pressures. In the low pressure position, the plunger 32 is stopped by and touches the stopping face 43 of the stopping element 33; in the high pressure position, the plunger 32 is stopped by and touches the stopping face 45 of the stopping element 35.

The pump housing 12 also comprises an intake port 37 for sucking the lubricant from a lubricant tank 50 and a pump outlet port 24 for feeding lubricant with a discharge pressure to the internal combustion engine 70. A conduit 71 extends from the pump outlet port 24 to supply the internal combustion engine 70.

The lubricant, which is supplied to the internal combustion engine 70, is also conducted to the pressure control chamber 20 via a first pressure conduit 26, and the lubricant is also conducted to the pretension cylinder 30 via a second pressure conduit 34. More specifically, the lubricant of second pressure conduit 34 is finally fed to the pretension cylinder 30 via the second pressure conduit 34 through a pressure throttle valve 46 in which a calibrated pressure drop occurs as the lubricant flows through. The second pressure conduit 34 is connected with an inlet 39 of the pretension cylinder 30.

The pretension cylinder 30 is provided with an outlet opening 36 in a cylinder wall 38, the outlet opening 36 being connected hydraulically to an electrical pretension control valve 40. The pretension control valve 40 is controlled by a pump control unit 44. The pump control unit 44 is provided with set-values for the pretension control valve 40 and determines the pressure set-value, and thereby the position, of the plunger 32, dependent on engine conditions and parameters, such as lubricant temperature etc.

If the electrical pretension control valve 40 opens the outlet opening 36, the pretension cylinder 30 is connected to the low-pressure, for example, to atmospheric pressure. The plunger 32 is in the low pressure position, and the equilibrium position of the control ring 18 is moved into the low pressure position. The pump 10 provides the pressurized lubricant, for example, with a pressure of approximately 2.5 bar. If the pretension control valve 40 closes the outlet opening 36, the pressure in the pretension cylinder 30 increases so that the plunger 32 switches into the high pressure position. As a result, the equilibrium position of the control ring 18 is shifted into the high pressure position so that the pump 10 provides the pressurized lubricant, for example, with a higher set pressure of approximately 4.5 bar.

The present invention is not limited to embodiments described herein; reference should be had to the appended claims.

What is claimed is:

1. A variable displacement lubricant pump for providing a pressurized lubricant for an internal combustion engine, the variable displacement lubricant pump comprising:

a control ring configured to be shiftable;

a pump housing comprising a pump rotor, the pump rotor comprising radially slidable vanes which are configured to rotate in the control ring, a first pressure conduit;

a second pressure conduit;

a pump outlet port;

a pressure control chamber configured to push the control ring into a low pumping volume direction against a force of a flexible pretensioning element, the pressure control chamber being connected with the pump outlet port via the first pressure conduit;

a pretension control unit configured to adjust at least one discharge pressure of the pressurized lubricant, the pretension control unit comprising a pretension cylinder comprising a plunger and an outlet opening arranged in a cylinder wall, the plunger being arranged so as to be axially moveable and to directly support the flexible pretensioning element so as to push the control ring into a high pumping volume direction, the pretension cylinder being connected with the pump outlet port via the second pressure conduit; and a pretension control valve, wherein, the outlet opening is connected to a low-pressure via the pretension control valve, and the flexible pretensioning element is arranged directly between the plunger and the control ring so that respective ends of the flexible pretensioning element contact only the plunger and the control ring.

2. The variable displacement lubricant pump as recited in claim 1, wherein the pretension cylinder further comprises a stopping element arranged at each axial end of the pretension cylinder.

3. The variable displacement lubricant pump as recited in claim 1, further comprising a pump control unit, wherein the pretension control valve is configured to be controlled electrically by the pump control unit.

4. The variable displacement lubricant pump as recited in claim 1, wherein the second pressure conduit comprises a throttle valve.

* * * * *